US011286665B2

(12) United States Patent
Cecchetto, Jr. et al.

(10) Patent No.: US 11,286,665 B2
(45) Date of Patent: Mar. 29, 2022

(54) ROOF PANEL SYSTEM

(71) Applicants: Blach Construction Company, San Jose, CA (US); Gregory P. Luth & Associates, Inc., Santa Clara, CA (US)

(72) Inventors: Gino R. Cecchetto, Jr., Woodside, CA (US); Gregory P. Luth, San Jose, CA (US)

(73) Assignees: Blach Construction Company, San Jose, CA (US); Gregory P. Luth & Associates, Inc., Santa Clara, CA (US)

( * ) Notice: Subject to any disclaimer, the term of this patent is extended or adjusted under 35 U.S.C. 154(b) by 0 days.

(21) Appl. No.: 16/773,820

(22) Filed: Jan. 27, 2020

(65) Prior Publication Data

US 2020/0232214 A1 Jul. 23, 2020

Related U.S. Application Data

(63) Continuation of application No. 15/975,089, filed on May 9, 2018, now Pat. No. 10,544,585.

(60) Provisional application No. 62/503,855, filed on May 9, 2017.

(51) Int. Cl.
*E04B 7/20* (2006.01)
*E04B 7/02* (2006.01)

(52) U.S. Cl.
CPC ..... *E04B 7/20* (2013.01); *E04B 7/024* (2013.01)

(58) Field of Classification Search
CPC ..... E04B 7/20; E04B 7/024
See application file for complete search history.

(56) References Cited

U.S. PATENT DOCUMENTS

| | | | |
|---|---|---|---|
| 1,900,721 | A | 3/1933 | Manske et al. |
| 2,371,921 | A | 3/1945 | Tucker |
| 3,110,131 | A | 11/1963 | Jeffress |
| 3,172,507 | A | 3/1965 | Blyveis |
| 3,368,016 | A | 2/1968 | Birguer |
| 3,849,012 | A | 11/1974 | Krouse |
| 3,994,107 | A | 11/1976 | Aughuet |

(Continued)

FOREIGN PATENT DOCUMENTS

| | | | |
|---|---|---|---|
| GB | 1487244 | A | 9/1977 |
| GB | 1516300 | A | 7/1978 |
| GB | 2232427 | A | 12/1990 |

OTHER PUBLICATIONS

U.S. Patent and Trademark Office, Non-Final Office Action in U.S. Appl. No. 15/959,019, dated Oct. 18, 2018, 12 pages.

(Continued)

*Primary Examiner* — Rodney Mintz
(74) *Attorney, Agent, or Firm* — Kolisch Hartwell, P.C.

(57) ABSTRACT

The present disclosure provides systems, apparatuses, and methods relating to roof construction. In some embodiments, a roof panel system may include a prefabricated horizontal building frame and a prefabricated roof panel structure. The horizontal building frame component may include a plate having a first aperture. The prefabricated roof panel structure may include two parallel lateral structural members and two parallel transverse structural members, one of the transverse structural members having a second aperture. The system may further include a fastener assembly connecting the horizontal building frame component to the roof panel structure through the first and second apertures.

8 Claims, 6 Drawing Sheets

(56) References Cited

U.S. PATENT DOCUMENTS

| | | | | |
|---|---|---|---|---|
| 4,071,988 | A * | 2/1978 | Bowes | E04B 1/3511 52/127.1 |
| 4,073,107 | A | 2/1978 | Rousseau | |
| 4,141,188 | A | 2/1979 | Sukolics | |
| 4,192,481 | A | 3/1980 | Durbin | |
| 4,194,333 | A | 3/1980 | Paton et al. | |
| 4,398,378 | A | 8/1983 | Heitzman | |
| 4,506,482 | A | 3/1985 | Pracht et al. | |
| 4,905,444 | A | 3/1990 | Semaan et al. | |
| 5,617,685 | A | 4/1997 | Meier et al. | |
| 6,003,280 | A | 12/1999 | Wells | |
| 6,012,699 | A | 1/2000 | Wu et al. | |
| 6,058,668 | A | 5/2000 | Herren | |
| 6,216,405 | B1 | 4/2001 | Smith | |
| 6,240,682 | B1 | 6/2001 | James et al. | |
| 6,470,644 | B2 | 10/2002 | James et al. | |
| 6,503,025 | B1 | 1/2003 | Miller | |
| 6,550,213 | B1 | 4/2003 | Butler | |
| 7,596,923 | B1 | 10/2009 | Thomas et al. | |
| 7,802,406 | B2 | 9/2010 | Simmons | |
| 7,866,108 | B2 | 1/2011 | Klein | |
| 8,312,678 | B1 | 11/2012 | Haddock | |
| 8,474,220 | B2 | 7/2013 | Svensson | |
| 8,528,296 | B1 | 9/2013 | Miller | |
| 8,555,592 | B2 | 10/2013 | Daudet et al. | |
| 8,763,328 | B2 | 7/2014 | Tuttle | |
| 9,032,681 | B1 | 5/2015 | Brady | |
| 9,663,961 | B2 | 5/2017 | Moeller et al. | |
| 9,915,064 | B1 | 3/2018 | Sanders et al. | |
| 10,196,808 | B1 | 2/2019 | Gibbs et al. | |
| 10,544,584 | B2 * | 1/2020 | Cecchetto, Jr. | E04B 2/828 |
| 10,544,585 | B2 * | 1/2020 | Cecchetto, Jr. | E04B 7/024 |
| 10,550,565 | B2 | 2/2020 | Heatly | |
| 10,550,572 | B2 * | 2/2020 | Webb | E04C 3/20 |
| 10,584,479 | B2 * | 3/2020 | Saenz Saenz | E04B 1/02 |
| 2001/0025458 | A1 | 10/2001 | James et al. | |
| 2003/0131544 | A1 | 7/2003 | Miller | |
| 2003/0233798 | A1 | 12/2003 | Berkey et al. | |
| 2005/0252149 | A1 | 11/2005 | Ritchey et al. | |
| 2008/0222976 | A1 | 9/2008 | Liskey | |
| 2010/0115880 | A1 | 5/2010 | Svensson | |
| 2011/0203217 | A1 | 8/2011 | Dayton et al. | |
| 2018/0305925 | A1 | 10/2018 | Cecchetto, Jr. et al. | |
| 2018/0328034 | A1 * | 11/2018 | Cecchetto, Jr. | E04B 7/20 |
| 2018/0371742 | A1 * | 12/2018 | Saenz Saenz | E04B 1/3511 |
| 2019/0010700 | A1 | 1/2019 | Webb et al. | |
| 2019/0257081 | A1 | 8/2019 | Heatly | |
| 2021/0285205 | A1 * | 9/2021 | Ohde | E04B 1/19 |

OTHER PUBLICATIONS

U.S. Patent and Trademark Office, Non-Final Office Action in U.S. Appl. No. 15/959,019, dated May 14, 2019, 8 pages.

U.S. Patent and Trademark Office, Non-Final Office Action regarding U.S. Appl. No. 15/975,089, dated May 22, 2019, 10 pages.

U.S. Patent and Trademark Office, Non-Final Office Action in U.S. Appl. No. 16/773,665, dated Oct. 7, 2020, 17 pages.

U.S. Patent and Trademark Office, Non-Final Office Action regarding U.S. Appl. No. 16/539,964, dated Nov. 24, 2020, 26 pages.

U.S. Patent and Trademark Office, Final Office Action regarding U.S. Appl. No. 16/773,665 dated Jan. 21, 2021, 16 pages.

U.S. Patent and Trademark Office, Non-Final Office Action regarding U.S. Appl. No. 16/773,665, dated Jun. 9, 2021, 7 pages.

* cited by examiner

ROOF PANEL SYSTEM

CROSS-REFERENCES

This application is a continuation of U.S. patent application Ser. No. 15/975,089, filed May 9, 2018, issued as U.S. Pat. No. 10,544,585 on Jan. 28, 2020, which claims priority from U.S. Provisional Patent Application Ser. No. 62/503,855, filed May 9, 2017. The complete disclosures of each application are hereby incorporated by reference in their entireties for all purposes.

The following related patent application is also incorporated by reference, in its entirety, for all purposes: U.S. patent application Ser. No. 15/959,019.

INTRODUCTION

Panelized buildings, also known as prefabricated buildings, offer a flexible and cost-efficient alternative to traditionally constructed buildings. Such buildings are being used in a wider variety of applications including schools, office buildings, medical buildings, and even residential housing. Panelization allows a portion of welding and other construction work to be performed prior to building erection, reducing on-site work. Work performed off-site simplifies scheduling, reduces construction costs, is performed under controlled conditions, and is generally of higher quality.

In many panelized buildings, the roof is constructed by attaching individual rafter beams to the building frame and then welding decking to the beams. This process is performed by workers on top of the building and on the ground below. A simpler construction process reducing the work performed on top of the building is desirable to improve safety and reduce construction time.

SUMMARY

The present disclosure provides systems, apparatuses, and methods relating to roof construction. In some embodiments, a roof panel system may include a prefabricated building frame component and a prefabricated roof panel structure. The building frame component may include a plate having a first aperture. The prefabricated roof panel structure may include two parallel lateral structural members and two parallel transverse structural members, one of the transverse structural members having a second aperture. The system may further include a fastener assembly connecting the building frame component to the roof panel structure through the first and second apertures.

In some embodiments, a roof of a building may include a plurality of roof panel structures, each having two parallel lateral structural members and two parallel transverse structural members. One of the transverse structural members of each roof panel may be coupled to a plate by a fastener assembly, the plate being connected to a frame member of the building. Each roof panel structure may also be coupled to an adjacent roof panel structure by a fastener assembly.

A method of constructing a roof may include prefabricating a modular roof structure including two parallel lateral structural members and two parallel transverse structural members, where at least one of the transverse members has a first aperture. The method may further include lifting the roof structure onto two structural members of a building frame, where one of the structural members includes a plate having a second aperture. The method may further include supporting the roof structure on the structural members and the plate, and connecting the roof structure to the building frame with a fastener assembly extending through the first and second apertures.

Features, functions, and advantages may be achieved independently in various embodiments of the present disclosure, or may be combined in yet other embodiments, further details of which can be seen with reference to the following description and drawings.

DETAILED DESCRIPTION

Figure 1:
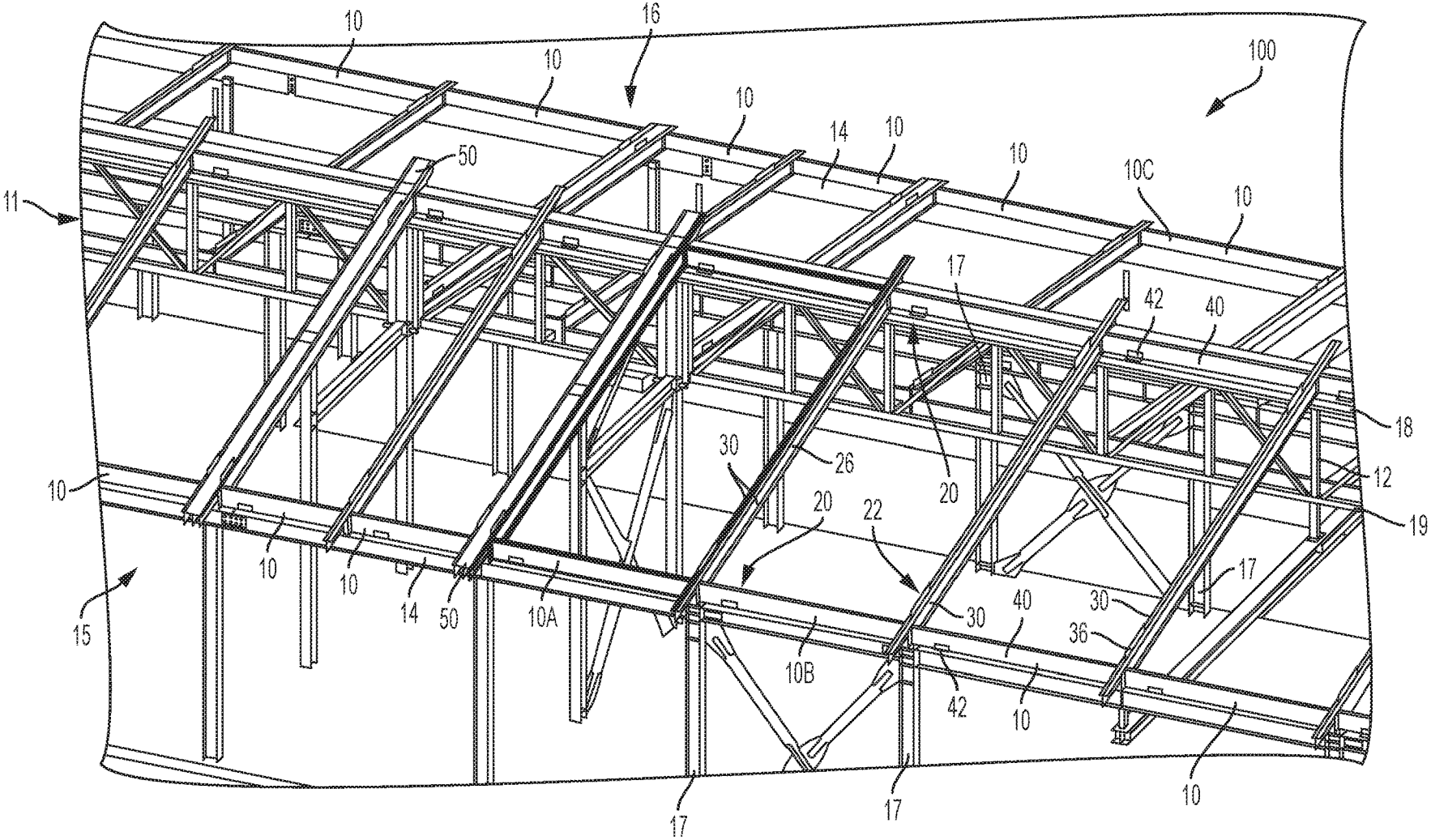
FIG. 1 is an isometric view of an illustrative building frame with a plurality of attached roof panels, decking omitted.

This disclosure provides numerous selected examples of invented devices and methods for roof construction. Many alternatives and modifications which may or may not be expressly mentioned, are enabled, implied, currently possessed, and are supported by the disclosure.

A roof panel system may include a prefabricated roof structure and a prefabricated building frame member. The roof structure and building frame member may be configured for connection to one another by a fastener assembly. The roof structure may also be referred to as a roof panel. The building frame member may be a horizontal, vertical, or sloped structural member, such as a roof beam, column, or truss.

The roof panel may be rectangular in shape, including a first pair of parallel panel frame members and a second pair of parallel panel frame members. In some examples, the roof panel may be non-rectangular in shape, and include any appropriate number or arrangement of frame members. When installed on a building frame that includes the prefabricated building frame member, the roof panel may span between first and second building frame structural members. In some examples, one of the building frame structural members may be the prefabricated building frame member.

The first pair of parallel panel frame members may be disposed parallel to the first and second building frame structural members, which may be horizontal. Each of the first pair of parallel panel frame members may be connected to the first or second building frame structural member by one or more fastener assemblies. One of the first pair of parallel panel frame members may be a top edge of the roof panel, and the other may be a bottom edge of the roof panel.

The prefabricated building frame member may include a protruding structure having one or more apertures. The roof panel may include a corresponding one or more apertures. In some examples, the apertures of the roof panel may also be in a protruding structure fixed to a panel frame member and/or may be in a panel frame member. The corresponding apertures of the building frame member and the roof panel may be configured to receive fastener assemblies, the roof panel being thereby connected to the building frame.

The protruding structure of the prefabricated building frame member may be angled relative to a vertical direction of the building frame, and may be configured to support the weight of the roof panel. That is, contact between the protruding structure of the building frame member and the roof panel may prevent motion of the roof panel resulting from gravitational forces.

The roof panel system may further include one or more additional prefabricated roof panels and/or prefabricated building frame members. A plurality of roof panels and frame members may be connected together by fastener assemblies to form a roof. Each roof panel may be connected to the building frame and to one or more adjacent roof panels.

Each roof panel may include one or more apertures corresponding to apertures of an adjacent roof panel. In some examples, the apertures may be in a protruding structure fixed to a panel frame member and/or may be in a panel frame member. The corresponding apertures of two adjacent roof panels may be configured to receive fastener assemblies, the two roof panels being thereby connected to one another.

Together, the plurality of roof panels may act as a structural diaphragm of the building frame. The roof panels, prefabricated building frame members, and/or connections therebetween may be configured to distribute shear forces appropriately, such that the building is seismically robust and/or abides by relevant building codes.

FIG. 1 shows a building with an illustrative roof panel system 100, including a plurality of prefabricated roof structures, referred to as roof panels 10, and components of a building frame 11. The roof of the depicted building includes a clerestory defined by a truss 12 of building frame 11, that divides the roof into a high roof 15 and a low roof 16. The building frame further includes roof beams 14 above exterior and interior walls.

Roof panels 10 of high roof 15 span between a top chord 18 of truss 12 and a roof beam 14 at an outer wall. The roof panels of low roof 16 span between a bottom chord 19 of the truss and roof beams 14 at an interior and an exterior wall, respectively. Each roof panel 10 is connected to building frame 11 by two or more frame connections 20 and to adjacent roof panels by one or more inter-panel connections 22.

Roof panel system 100 includes multiple prefabricated components, and is configured to limit quantity and complexity of work required at the building site for erection of a roof. Welding needed for system components is performed in the shop, and components are bolted or otherwise fastened together in the field. More specifically, roof panels 10 are prefabricated in the shop and may be delivered to the building site ready for connection. Further, the components of building frame 11 included in the roof panel system are also prefabricated. For example, plates, stiffeners, and/or any appropriate connection features may be welded or otherwise attached to structural members such as roof beams 14 and chords 18, 19 prior to delivery at the building site.

Roof panel system 100 is also configured to act as a structural diaphragm of the building, and transfer shear loads to the vertical members of building frame 11. A deck of the roof panels may carry in-plane shear forces and support further roof materials and attached structures against gravitational forces. Frames of the roof panels may collect the in-plane shear forces from the deck and deliver the resulting forces to plates of frame connections 20. The frames may also similarly support against gravitational forces. Frame connections 20 may transfer gravitational and seismic forces collected by the roof panels to the primary structural framework of the building.

Frame connections 20 and inter-panel connections 22 may be selected to provide stiffness, flexibility, and/or other structural properties necessary for desired diaphragmatic action of the roof panel system. Roof panels 10 may be similarly designed to provide desired structural properties. The roof panels may be configured to remain linear in seismic events, and disposed such that expansion is allowed under thermal loads and/or typical growth during fabrication.

In the present example, building frame 11 is comprised of steel beams and columns. In some examples, a roof panel system may include and/or may be used with building frame components of other appropriate construction and/or material. For example, a residential building may have a timber frame and a roof panel system for such a building may include timber top plates or other appropriate members.

Each roof panel 10 includes a panel frame 26 and decking 28 coupled to an outward facing edge of the frame. Decking 28 is not pictured in FIG. 1, but can be seen in FIGS. 3, 4, and 6. The decking comprises a plurality of sections welded to the panel frame. Some sections of decking may be left un-connected during prefabrication to facilitate access to attachment points during erection. In the present example, uppermost and lowermost sections of decking are not welded into place, but instead laid upside-down on an adjacent section for transportation to the building site. Workers standing on roof panel 10 or the building may access frame connections where a decking section has not yet been attached.

In some examples, some or all of the plurality of roof panels 10 may be prefabricated without decking, which may instead be installed during construction of the building. A roof panel may include metal, timber, and/or any appropriate form of decking partially or fully attached to panel frame 26.

Panel frame 26, as shown in FIG. 1, includes two parallel lateral structural members 30, and two parallel transverse structural members 40. In the present example, the lateral structural members and transverse structural members are steel C-channels, with flanges extending into an interior of panel frame 26. Accordingly, lateral structural members are herein referred to as side channels and transverse structural members are referred to as transverse channels. In some examples, I-beams or other types of flanged beams, timber beams, and/or any structurally appropriate elongate member may be used for structural members of panel frame 26.

Side channels 30 are welded perpendicular to transverse channels 40, forming a generally rectangular shape of roof panel 10. In some examples, additional structural members may be included to reinforce the frame or form another shape. For instance, the roof panels of low roof 16 further include a third transverse channel 40. The number and/or position of structural members may be configured to facilitate connection with building frame 11 and/or provide desired structural properties to the roof panel.

A length of side channels 30 is selected for each roof panel 10, to correspond to the distance spanned by the roof panel. For instance, side channels 30 of roof panels of high roof 15 are of a length matching a distance between top chord 18 of truss 12 and the corresponding roof beam 14, with additional length to form eaves. A length of transverse channels 40 is selected to match a layout of building frame 11, such as spacing between columns.

The length of the transverse channels may also be selected such that each roof panel has a width less than a cargo width of a standard vehicle. In other words, roof panels 10 may be small enough to be transported to a building site with common building materials. In the present example, each roof panel is therefore approximately 10 feet in width or less, to enable easy shipment with a standard wide-load trucking permit. Panels may be any appropriate size. In some examples, dimensions of roof panels 10 may be multiples or fractions of a standard size for the building, to conform to a grid layout. Multiple panels may be interchangeable and have matching dimensions, each panel may be sized and configured appropriate to a specific position, and/or any combination thereof.

Each side channel 30 further includes cut-outs 34 at first and second ends to form eaves, and allow clearance for installation of walls. Cut-outs 34 vary between the roof panels of high roof 15 and of low roof 16. The roof panels of high roof 15 include cut-outs at upper and lower ends of side channels 30, while the roof panels of low roof 16 include cut-outs at only lower ends of side channels 30. In some examples, eaves may be bolted onto side channel 30, or other structures may be welded onto the end of the side channel. Any structures or modifications appropriate to construction or appearance of a building may be included at the ends of the side channels of the roof panels.

Each roof panel 10 connects to building frame 11 at two points, to an upper horizontal building frame component and to a lower building frame component. Roof panel 10 may be described as connected to the lower building frame component at a bottom edge, and to the upper building frame at a top edge. Some roof panels of the plurality of roof panels connect to building frame 11 at three or more points. At each connection point, any appropriate number and/or type of frame connections 20 may be used. The roof panel may connect to any horizontal structural members of the building. In some examples, roof panel 10 may be connected to each horizontal building frame component by only one frame connection 20.

Each roof panel 10 is also connected to adjacent roof panels, by inter-panel connections 22. Any appropriate number of panels may be coupled together. One or more roof panels of a plurality of connected roof panels may also be coupled to a rafter or collector for additional structural support. In FIG. 1, a first roof panel 10A is shown bolted to collector 50. The roof panel may be bolted to collector 50 in a similar manner as the panel is bolted to an adjacent second roof panel 10B. Alternatively, first roof panel 10A may be welded to collector 50. The collector may in turn be welded or otherwise coupled to one or more horizontal structural members of the building.

The plurality of roof panels may form a simple gabled or shed roof, or a more complex roof structure as in the present example. In addition to the connections described herein, a roof panel may be further connected to a building frame or another roof panel. For example, in a gabled roof, an upper transverse channel 40 of a first roof panel may be coupled in some manner to an upper transverse channel of a second roof panel on an opposite slope of the roof. In such an example, the side channels of each panel may have only lower eave cut-outs to allow the transverse channels to contact.

As shown in FIG. 1, first roof panel 10A and second roof panel 10B are attached to building frame 11 such that a side channel 30 of first roof panel 10A is adjacent a side channel 30 of second roof panel 10B. An outer flat surface of each side channel is generally parallel to and facing the outer flat surface of the other side channel. In examples where c-channels are used for the lateral structural members of panel frames 26, the two side channels may together form an I-beam shape, as is often used for a rafter in traditional roof framing.

Figure 2:
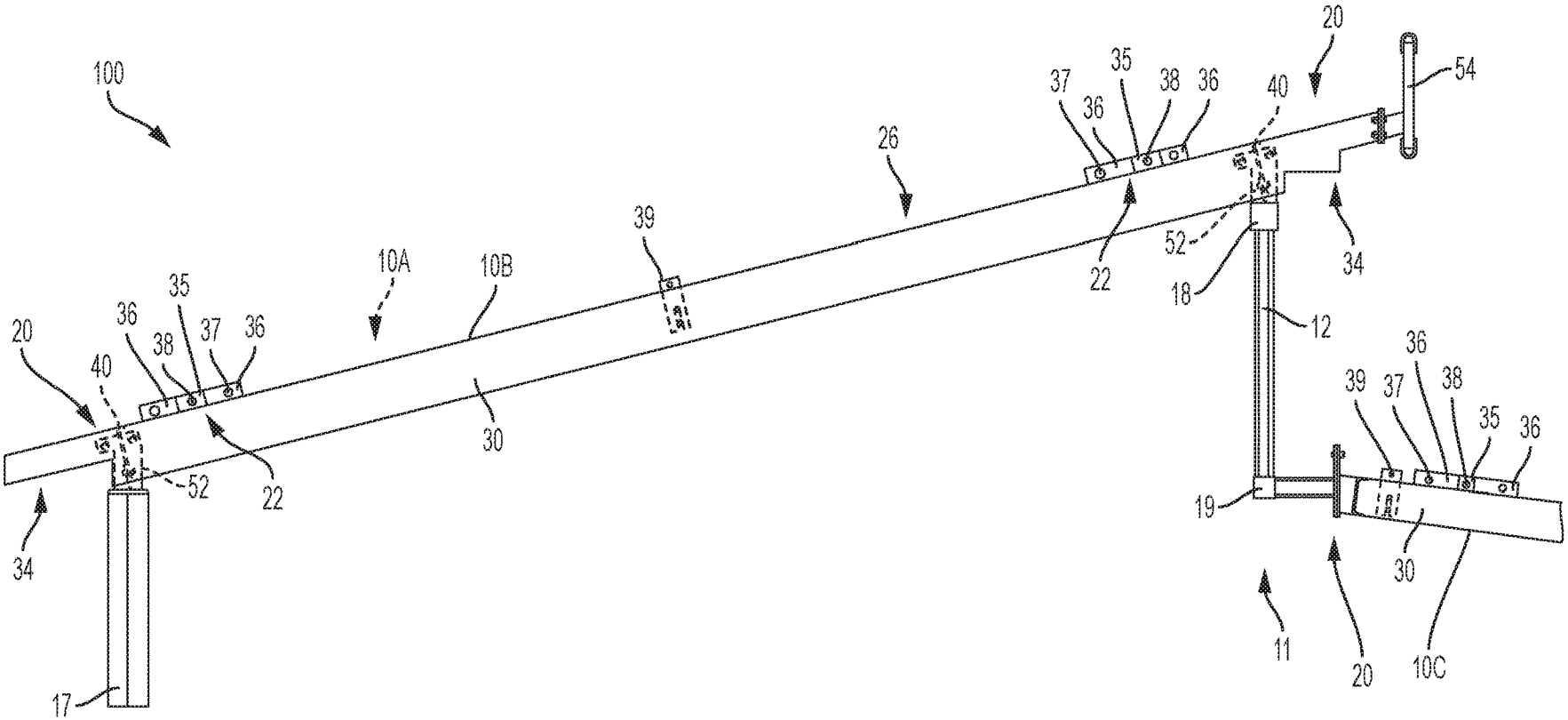
FIG. 2 is a partial elevation view of the building frame of FIG. 1, showing two roof panels with decking omitted.

Two rigging plates 36 are coupled to each side channel 30 of each roof panel 10, the rigging plates extending up past the outward facing edge of frame 26. The rigging plates of first roof panel 10A and second roof panel 10B are shown more clearly in FIG. 2, which is an elevation view of the two connected roof panels. In FIG. 2, one side channel 30 of roof panel 10B is shown, facing out from an interior of the roof panel frame and toward roof panel 10A. Roof panel 10A is referenced with a dashed arrow, to indicate the panel's location behind roof panel 10B.

Each rigging plate 36 includes an aperture 37 that is configured to act as a rigging point. Together, the four rigging points on each roof panel 10 may facilitate lifting of the roof panel into place on building frame 11. Once the roof panel is placed, the rigging points may also serve as fall protection points for workers performing installation.

Each rigging plate 36 further includes an aperture 38 configured to receive a fastener assembly. Adjacent rigging plates 36 of first roof panel 10A and second roof panel 10B are disposed such that fastener apertures 38 are aligned when the first and second roof panels are connected to building frame 11. A fastener assembly secured through the aligned apertures connects the first and second roof panels. In other words, each rigging plate 36 also includes one or more apertures corresponding to apertures on an adjacent roof panel rigging plate. The two rigging plates may be connected by one or more fasteners extending through the corresponding apertures.

Adjacent rigging plates 36 of two roof panels, together with a fastener assembly, form an inter-panel connection 22. Any appropriate fastener assembly may be used. In the present example, the rigging plates are secured together with a standard nut and bolt. A washer plate 35 is also disposed between corresponding rigging plates 36, to establish correct spacing between the rigging plates and further secure the connection.

As shown in FIG. 2, rigging plates 36 extending from a first side channel 30 of frame 26 and the rigging plates extending from a second side channel of the frame are not symmetrical. The plates are staggered such that rigging point apertures 37 of adjacent rigging plates on two roof panels are spaced from one another. This spacing may prevent interference from rigging plates of previously erected roof panels when lifting a roof panel into place on building frame 11.

Figure 3:
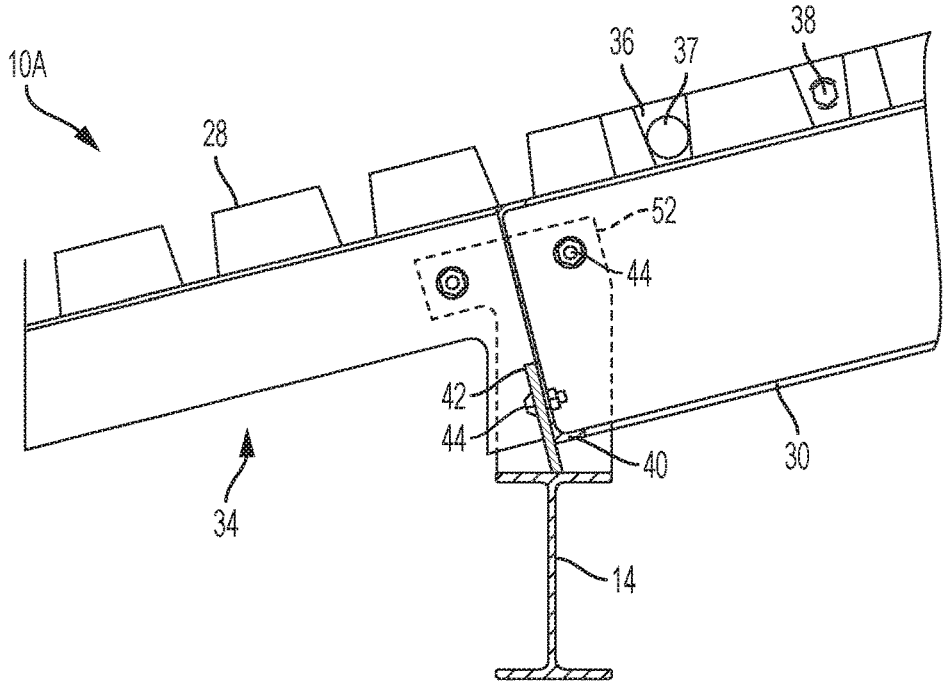
FIG. 3 is a detail view of the roof beam connection of FIG. 2.

In FIG. 3, a top edge of rigging plate 36 is shown flush with a top surface of decking 28. In the present example of a standing seam metal roof, rigging point aperture 37 and fastener aperture 38 are aligned between raised portions of decking 28 to allow access. That is, both bolt apertures and rigging point apertures are disposed in the rigging plate 36 such that all apertures fall between flutes of decking 28 and are accessible from above the decking. In some examples, rigging plates 36 may extend sufficiently past decking 28 to allow access to the apertures. In some examples, the rigging plates may further protrude through subsequent layers of roofing materials in order to continue to act as a fall protection point throughout the roof installation process. Adjacent side channels 30 of connected roof panels 10 are spaced from one another, although the spacing may be difficult to discern in FIG. 1. For a roof panel with a width of 10 feet, spacing between side channels may be approximately one eighth of an inch. This spacing may allow for expansion of roof panels 10 under load or due to environmental changes such as temperature fluctuation.

The spacing may also facilitate roof assembly by accommodating tolerance in dimensions of roof panels 10. As a consequence, roof panels 10 may not be evenly spaced. To adjust panel spacing during construction a shim 39 may be used, as shown in FIG. 2. Two shear bolts extend through corresponding apertures in adjacent side channels of two roof panels. Shim 39 has a clothes-pin shape, with fingers configured to extend on either side of the bolts. Correct spacing between panels may also be established by washer plates 35 and/or vertical shear plates as described below.

In the present example, shim 39 has a width of three eighths of an inch, but any appropriate shim or spacer may be used. A shim may be disposed at a midpoint of side channel 30 or at any point along the side channel. Any appropriate number of shims may be used.

In some examples, a spacer bar may be disposed between the panels, such that a flat face of a side channel 30 of first roof panel 10A is in contact with a first side of the spacer bar, and a flat face of a side channel 30 of second roof panel 10B is in contact with a second, opposite side of the spacer. A plurality of apertures may be formed in the side beams and the spacer bar, and a plurality of fastener assemblies may connect the first and second roof panels through corresponding apertures.

As shown in FIG. 2, the present example includes three types of frame connection 20. The three types may be referred to as a stop plate, a shelf plate, and a shear plate. Roof panels 10A and 10B of high roof 15 are each connected to top chord 18 and roof beam 14 by stop plates. That is, roof panel 10A is connected to top chord 18 by only one stop plate, and is connected to roof beam 14 by only one stop plate. In the present example, the roof panels are also connected to the top chord, roof beam and column 17 by vertical shear plates. In some examples, the roof panels may be connected to the building frame by stop plates alone.

A third roof panel 10C of lower roof 16 is connected to bottom chord 19 by a shelf plate. Other examples of frame connections may include structural features appropriate to accommodate particular roof designs. Any effective frame connection and/or combination of connections may be used.

Figure 4:
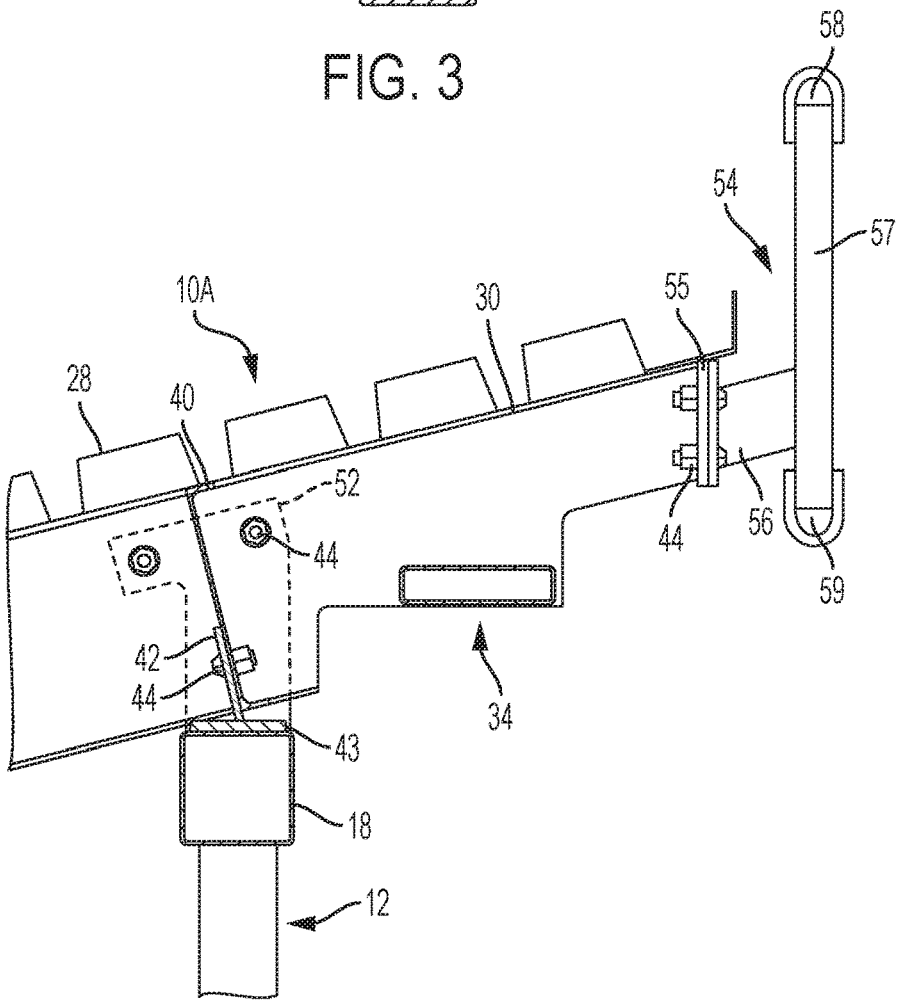
FIG. 4 is a detail view of the upper truss connection of FIG. 2.
Figure 5:
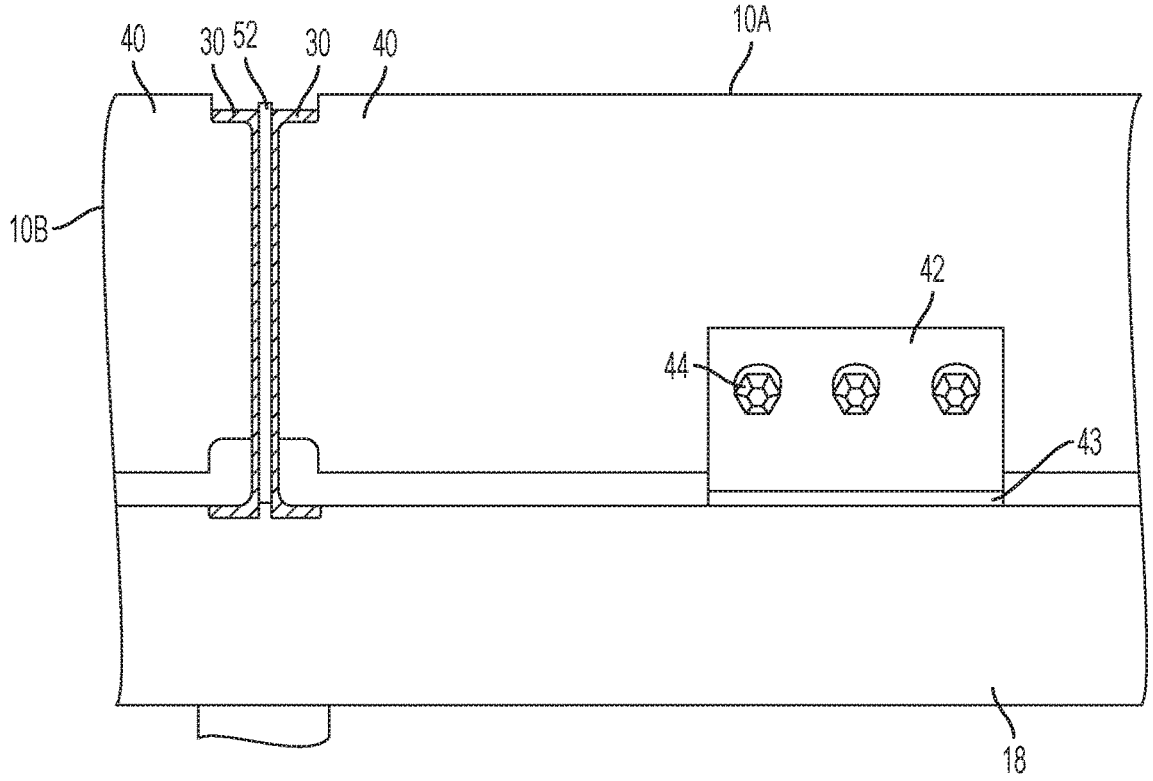
FIG. 5 is another detail view of the upper truss connection of FIG. 2, facing up the slope of the roof.

As shown in more detail in FIGS. 3-5, a stop plate frame connection includes an angled plate 42. The angled plate, which may also be referred to as a stop plate, is fixed to an upper surface of a horizontal structural member of the building frame. At the lower end of roof panel 10A, as shown in FIG. 3, stop plate 42 is welded to roof beam 14. At the upper end of roof panel 10A, as shown in FIG. 4, stop plate 42 is welded to a cap plate 43 which is in turn welded to top chord 18.

In each connection, stop plate 42 extends approximately perpendicular to the slope of the roof. In other words, the plate is angled such that when a flat outer face of the corresponding transverse channel 40 contacts stop plate 42, side channels 30 of roof panel are disposed at the correct angle for the desired roof pitch. In some examples, transverse channels 40 may not be perpendicular to side channels 30 and stop plate 42 may extend at an angle other than 90 degrees with respect to the slope of the roof.

Stop plate 42 is disposed down the slope of the roof from transverse channel 40, and the roof panel rests against the stop plate. The stop plate therefore acts as a gravitational stop, preventing roof panel 10 from sliding off the building frame, or sliding down relative to the horizontal building frame member. The plate may act as a stop prior to completion of the frame connection, improving safety for workers installing the roof panel.

Stop plate 42 includes three apertures and the corresponding transverse channel 40 of roof panel 10 includes three corresponding apertures. As shown in FIG. 5, three fastener assemblies 44 extend through the three pairs of corresponding apertures to secure the roof panel to the building frame. Any number of apertures and/or fastener assemblies may be included, as required to appropriately transfer seismic and gravitational forces.

In the present examples, fastener assemblies 44 each include a nut and bolt. FIG. 5 is a view of the upper frame connection of roof panel 10A to top chord 18, but the lower frame connection at roof beam 14 is analogous and the present description may apply to both connections.

As shown in FIG. 5, stop plate 42 is disposed near to one side channel 30 of roof panel 10A, but spaced from the side channel. This spacing can also be seen in a broader context in FIG. 1. Stop plate 42 may be disposed at any appropriate point along transverse channel 40, and may include any number of apertures.

Figure 6:
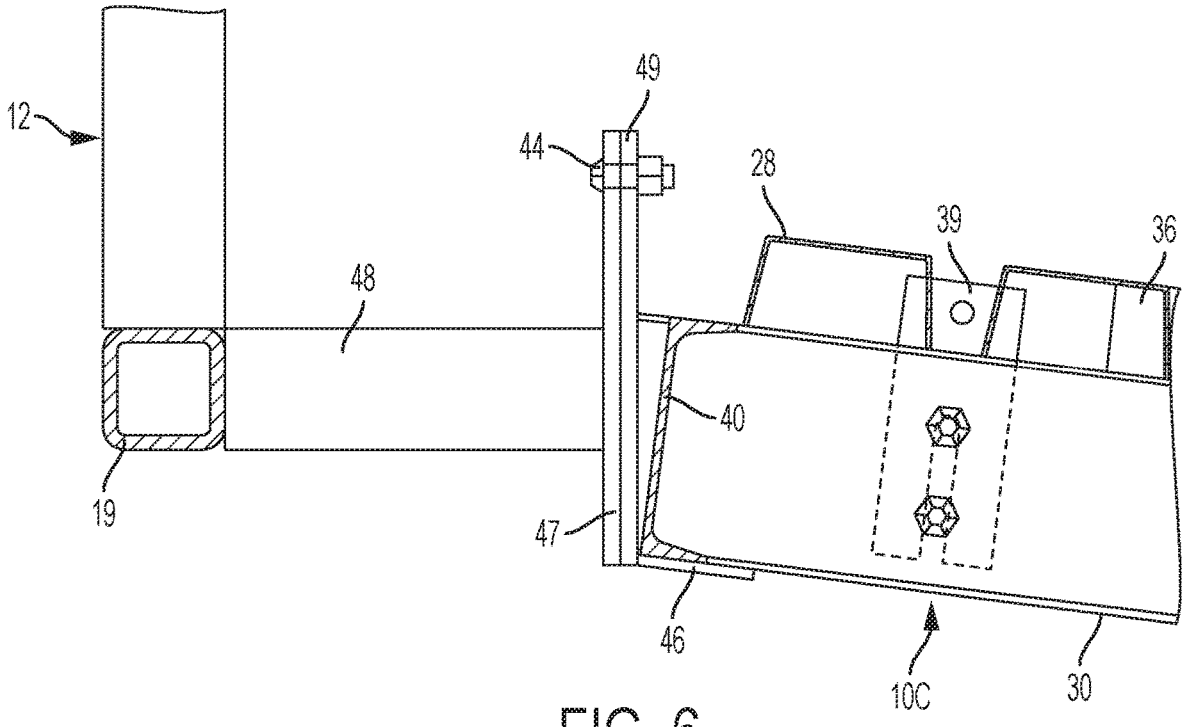
FIG. 6 is a detail view of the lower truss connection of FIG. 2.

As shown in FIG. 6, a shelf plate frame connection includes an angled plate 46. The angled plate may also be referred to as a shelf plate. Shelf plate 46 extends from an end plate 47 on a standoff 48. The standoff is in turn fixed to an outer face of bottom chord 19. In other words, together standoff 48, end plate 47 and shelf plate 46 form a shelf extending horizontally out from bottom chord 19 to receive a corner of roof panel 10C.

Roof panel 10C includes a corresponding end plate 49. Each of the end plates 47, 49 has a flat surface which is configured to contact the other plate. End plate 49 is fixed on upper transverse channel 40 and a side channel 30 of roof panel 10C at an angle, such that the end plate of the roof panel is aligned with end plate 47 of the bottom chord when the corner of the roof panel is received on shelf plate 46.

Shelf plate 46 extends from end plate 47 such that the shelf plate is at an angle relative to vertical that matches the slope of low roof 16. The shelf plate contacts a bottom edge of transverse channel 40 and side channel 30, the side channel therefore extending at the correct angle for the desired roof pitch.

Figure 7:
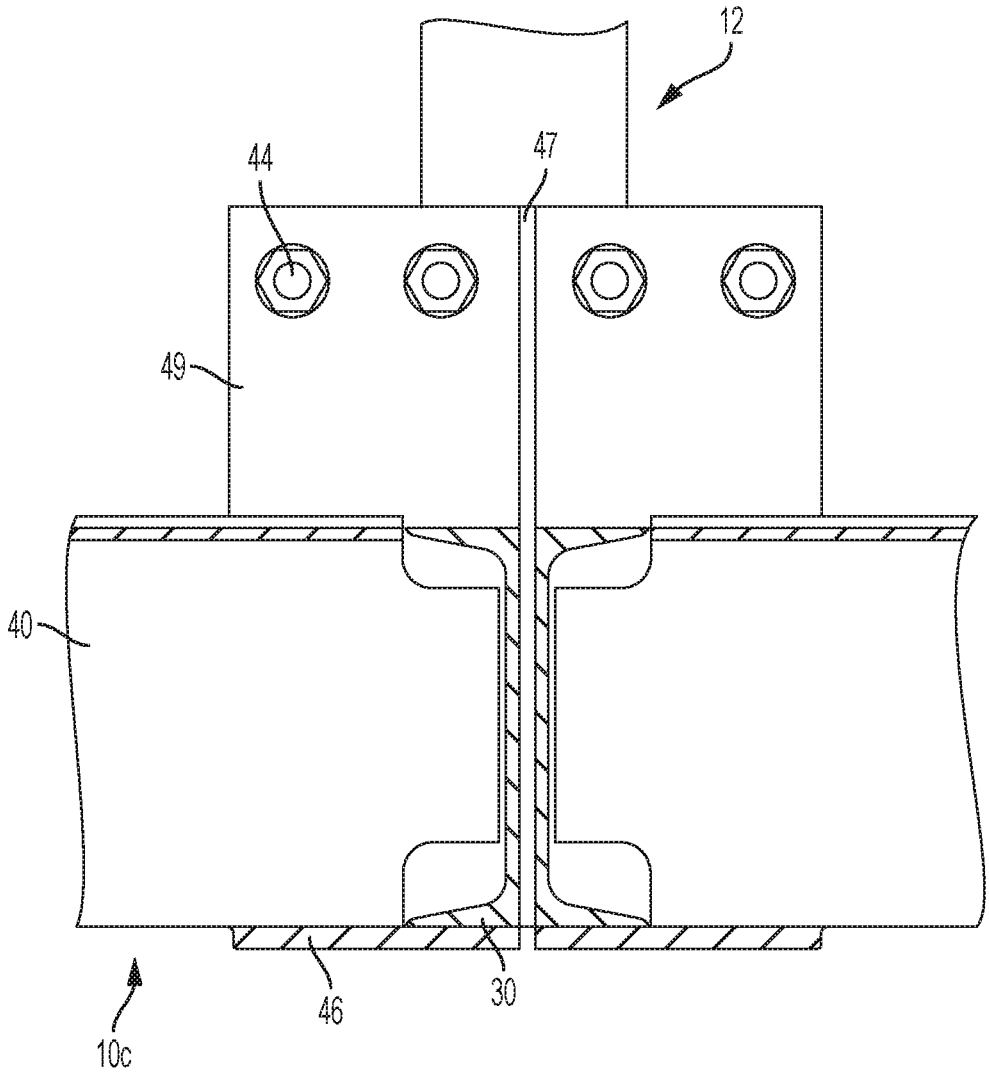
FIG. 7 is another detail view of the lower truss connection of FIG. 2, facing up the slope of the roof.

As shown in FIG. 7, end plate 47 of bottom chord 19 includes four apertures and end plate 49 of roof panel 10C includes two corresponding apertures. Two fastener assemblies 44 extend through the two pairs of corresponding apertures to secure the roof panel to the building frame. In the present examples, fastener assemblies 44 each include a nut and bolt.

Another end plate and shelf plate are also fixed to standoff 48, to similarly connect a corner of the adjacent roof panel to bottom chord 19. In some examples, a single end plate of standoff 48 may be fastened to end plates 49 of both adjacent roof panels. In some examples, shelf plate 46 may be fixed directly to bottom chord 19 and fastener assemblies 44 may extend through apertures in the bottom chord. In the present example, standoff 48 allows space between roof panel 10C and truss 12 to accommodate a clerestory wall. Other such structures may be included in a frame connection to facilitate a particular roof or wall design.

As shown in more detail in FIGS. 3-5, a shear plate frame connection includes a vertical plate 52. The vertical plate, which may also be referred to as a shear plate, is disposed between two adjacent roof panels, as shown in FIG. 5. It should be noted that in FIGS. 3 and 4 shear plates 52 are shown by dashed lines to indicate the shear plates' location behind side channel 30.

Each shear plate 52 is fixed to an upper surface of a horizontal or vertical structural member of the building frame. Shear plate connections fixed on columns may also tie the columns into the roof diaphragm, and improve response to out of plane loads. A roof panel may be connected by shear plate connections at some, all, or no corners of the roof panel. Shear plate connections may be disposed only on top of columns, or may be disposed in locations selected to provide desired stiffness or other structural properties to the roof.

FIG. 5 shows an edge-on view of shear plate 52, which is welded to top chord 18. The plate extends from an upper edge of the top chord, and is sandwiched between side channels 30 of roof panels 10A and 10B. Shear plate 52 has two apertures, corresponding to two apertures in the adjacent side channel 30 of each roof panel. A fastener assembly 44 extends through each of the two sets of three corresponding apertures, to secure roof panel 10A to roof panel 10B and to secure both roof panels to the building frame.

As shown in FIGS. 3 and 4, shear plate 52 is disposed proximate transverse channel 40 of roof panel 10A, and the two fastener assemblies are disposed on either side of the transverse channel. The shear plate is equivalently disposed relative to roof panel 10B. Shear plate 52 is approximately L-shaped, allowing this placement of the fastener assemblies. That is, the shear plate has a generally rectangular main portion extending vertically upward, and an arm portion extending down the slope of the roof. In some examples shear plate 52 may be strictly rectangular and may be secured by a single fastener assembly. The shear plate may have any effective shape and the connection may include any appropriate number, type, and/or disposition of fastener assemblies.

In the present example, a shear plate connection acts as both a frame connection 20 and an inter-panel connection 22. In some examples, a shear plate connection may act as only a frame connection. For instance, a shear plate may be disposed in contact with a side channel of a roof panel proximate the rake of a roof.

As noted above, the rigging plates of one or more roof panels may be used as fall protection points by construction workers. A roof panel system may further include one or more permanent tie-off points for fall protection during subsequent building maintenance. For instance, permanent tie-offs may simplify installation and maintenance of roof-mounted solar panel arrays.

In the present example, roof panel system 100 includes anchors 54, one of which is depicted in FIGS. 2 and 4. Anchor 54 is configured for connection to an upper end of adjacent side channels 30 of roof panels 10A and 10B. The anchor may be installed once the roof panels have been secured to the building frame.

Anchor 54 includes a brace 56 with a plate and a standoff, and a vertical bar 57 fixed to the standoff. At an upper end and a lower end, respectively, bar 57 has an upper eye 58 and a lower eye 59. In the present example, bar 57 is a rectangular metal tube and each eye is formed by a curved rod welded to an end of the tube. Workers may engage the rod with a clip and/or thread a line or cable through the eye.

As shown in FIG. 4, side channel 30 of roof panel 10A includes a connection plate 55 on the upper end. Roof panel 10B, not shown, includes a matching connection plate. Each connection plate 55 includes two vertically stacked apertures. Brace 56 of the anchor includes a corresponding four apertures. A fastener assembly extends through each pair of corresponding apertures to secure anchor 54 to roof panels 10A and 10B.

Anchor 54 and the connection to the roof panels are configured to support loads up to 5,000 pounds applied in any direction. Connection of the anchor to two roof panels may improve safety and stability of the connection. The anchor may also be configured to conform to any applicable safety regulations for fall protection points.

In the present example, each anchor 54 provides a tie-off point for the high roof and the low roof. That is, upper eye 58 of anchor 54 acts as a tie-off point for the high roof and the lower eye 59 acts as a tie-off point for the low roof. Anchor 54 may have any number of eyes and/or include any structures appropriate to a particular roof design.

Figure 8:
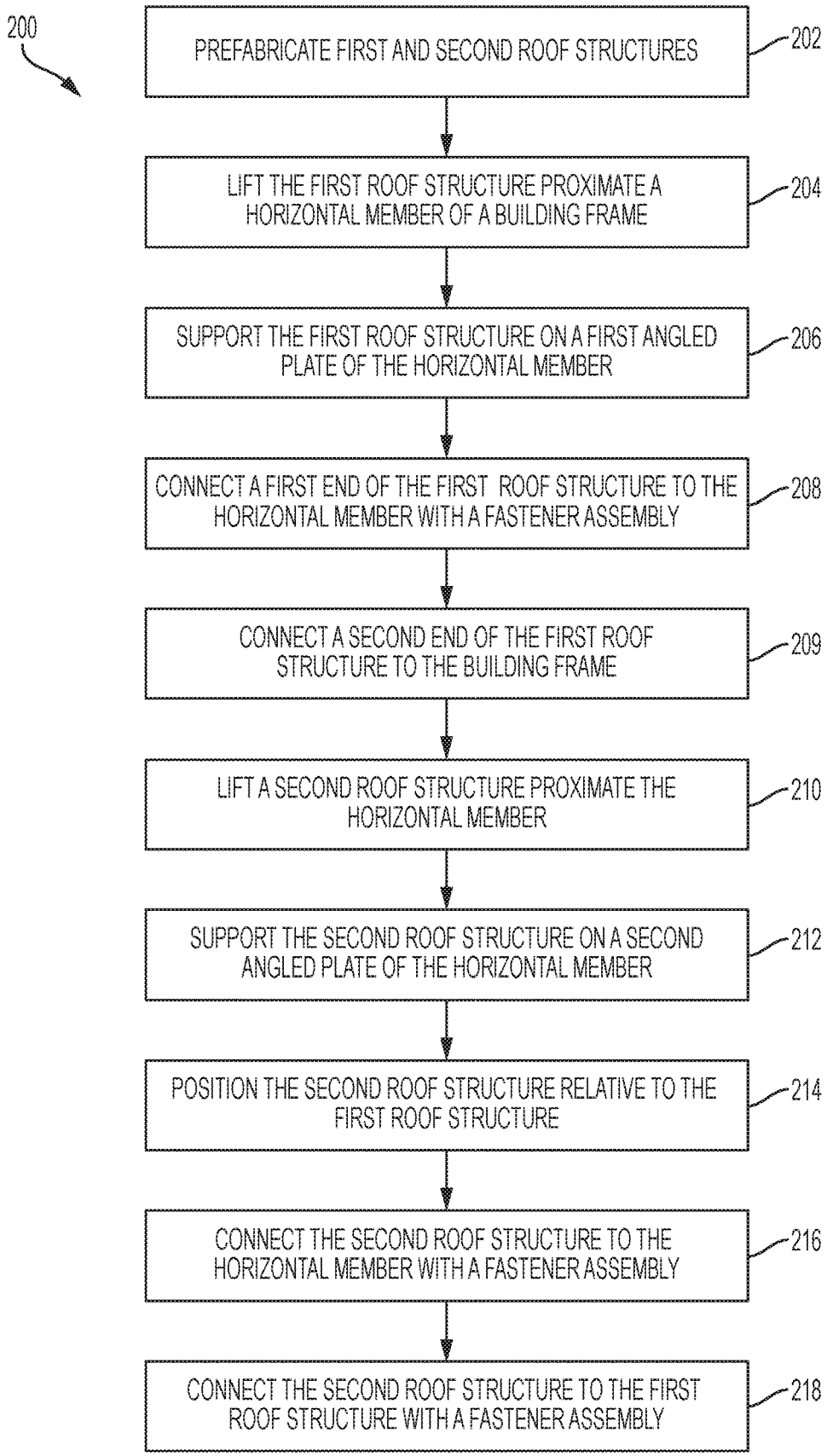
FIG. 8 is a flowchart illustrating a method of roof construction.

FIG. 8 is a flowchart illustrating steps of an illustrative method of roof construction. Aspects of the illustrative roof panel system described above may be utilized in the method steps described below. Where appropriate, reference may be made to components and systems that may be used in carrying out each step. These references are for illustration, and are not intended to limit the possible ways of carrying out any particular step of the method.

Although various steps of method 200 are described below and depicted in FIG. 8, the steps need not necessarily all be performed, and in some cases may be performed simultaneously or in a different order than the order shown. FIG. 8 may not recite the complete process or all steps of the method.

At step 202, the method includes prefabricating first and second roof structures. Each panel may be prefabricated according to a building plan, and may be identical and interchangeable or may be configured for installation in a specific predetermined location. The panels may be prefabricated in a factory, machine shop, and/or any appropriate location and then transported to a building site for installation.

Prefabrication may comprise fixing together four elongate members to form a generally rectangular frame. The elongate members may be steel C-channels, which may be welded together with flanges facing inward. A first pair of parallel frame members may span between a second pair of parallel frame members, proximal of either end of the first pair of parallel frame members. A section of each of the first pair of parallel frame members may therefore extend out past the second pair of parallel frame members.

That section may be cut to a shape appropriate to act as eaves, altered to accommodate a wall structure, and/or prepared for attachment of other structures. For example, a plate may be welded to an outer end of one section, configured for connection of a fall protection anchor. For another example, the section may be cut to a wedge shape and an angled plate may be welded on for a shelf plate frame connection as described above.

One or more apertures may be drilled, cut, or otherwise formed into the frame members. The apertures may be sized to receive a fastener such as a bolt. The apertures may be disposed on the frame such that they correspond to apertures or other structures of a building frame when positioned on the building frame.

Rigging points may be created on each roof structure, to facilitate selective attachment of lifting equipment during construction. For example, vertical rectangular plates may be fixed to an upper surface of the frame of the roof structure, having apertures appropriate to accept lifting cables. The vertical rectangular plates may be asymmetrically disposed on the frame, to prevent interference between rigging points during construction.

Decking may also be fixed to an upper surface of the frame of the roof structure. For example, panels of metal decking may be welded to the frame. A panel or section at first and second ends of the roof structure may be left un-welded, to allow access from above during construction to apertures or other connective structures on the roof structure frame. In some examples, end panels or sections may be temporarily secured upside-down to adjacent panels for transportation to the building site.

Step 202 may further include prefabricating one or more structural members of a building frame, which may be horizontal, vertical, or sloped. Similarly to the roof structures, the building frame members may be prefabricated according to a building plan, in a manufacturing setting, and then transported to a building site for erection.

Connection structures such as plates with apertures may be welded to beams, columns, and/or or other building frame members. For example, a rectangular plate having multiple apertures may be welded to a top flange of an I-beam at an angle corresponding to a desired roof slope. For another example, an approximately L-shaped plate may be welded perpendicular to a top surface of a box column.

At step 204, the method includes lifting the first roof structure proximate a horizontal member of a building frame. In some examples, the method may include a step of erecting prefabricated structural building frame members to form the building frame.

Lifting equipment may be attached to the roof structure. For examples, cables may be threaded through rigging points on the roof structure and attached to a crane hook. The roof structure may be lifted into position on the building frame, with two parallel lateral roof structure frame members extending similarly to rafters and with two parallel transverse roof structure frame members extending along adjacent horizontal building frame members. Corresponding apertures and/or other connection structures of the roof structure and the building frame may be aligned.

Step 206 includes supporting the first roof structure on a first angled plate of the horizontal member. The angled plate, which may comprise part of a prefabricated building frame member, may extend from an upper surface of the horizontal member. A transverse roof structure frame member may be brought into contact with an upper surface of the angled plate. In some examples, the angled plate may extend from a vertical side of a horizontal member. In some examples, lifting equipment may be released from the roof structure and the roof structure may be supported entirely by the angled plate and/or additional connection structures of the building frame. In some examples, the angled plate may provide a backup or auxiliary support of the roof structure.

Step 208 includes connecting a first end of the first roof structure to the horizontal member with a fastener assembly. A transverse frame member of the roof structure may include an aperture, aligned with a corresponding aperture in the angled plate of the horizontal member. Connecting may include installing a fastener assembly through the corresponding apertures. For example, the step may include extending a bolt through the corresponding apertures and threading a nut onto a distal end of the bolt. Securing the nut and bolt may thereby secure the roof structure to the horizontal member.

In some examples, the first roof structure may be connected to the horizontal member by only one angled plate and/or only one bolt. Alternatively, multiple plates and/or multiple bolts in each plate may be used to connect the first roof structure to the horizontal member.

Step 209 includes connecting a second end of the first roof structure to the building frame. The roof structure may be connected to a second horizontal member of the building frame, also having an angled plate. A second transverse frame member of the roof structure may include an aperture, aligned with a corresponding aperture in the angled plate of the second horizontal member. A second fastener assembly may secure the roof structure to the second horizontal member. The roof structure may be similarly secured to any number of horizontal members or other members of the building frame.

At step 210, the method includes lifting the second roof structure proximate the horizontal member. At step 212 the method includes supporting the second roof structure on a second angled plate of the horizontal member. Steps 210 and 212 may be substantially similar to steps 204 and 206, effectively repeating the steps for the second roof structure.

Step 214 includes positioning the second roof structure relative to the first roof structure. The second roof structure may be positioned alongside the first roof structure, with a lateral frame member of the second roof structure parallel to and proximate, but spaced from a lateral frame member of the first roof structure. That is, a gap may be disposed between the roof structures. The gap may be according to a building plan, or may be selected at the time of positioning.

The gap between the first and second roof structures may be configured to allow horizontal expansion of the roof structures. The first and second roof structures may also be positioned relative to the building frame, to form a desired roof geometry and/or align with structures of the building frame. For example, a shim may be inserted between the first and second roof structures, to achieve a desired spacing.

In an example where shims are used, the roof structures may be prefabricated with corresponding holes in adjacent frame members. One or more shear bolts may be installed through the corresponding holes, leaving a portion of bolt exposed in the gap between roof structures. A shim having a central slot may be inserted into the gap, to engage the exposed portion of shear bolt.

Step 216 includes connecting the second roof structure to the horizontal member with a fastener assembly. A transverse frame member of the second roof structure may include an aperture, aligned with a corresponding aperture in the second angled plate of the horizontal member. Similarly to step 208, connecting may include installing a fastener assembly through the corresponding apertures. For example, the step may include extending a bolt through the corresponding apertures and threading a nut onto a distal end of the bolt. Securing the nut and bolt may thereby secure the second roof structure to the horizontal member.

Step 218 includes connecting the second roof structure to the first roof structure with a fastener assembly. Each roof structure may include an aperture disposed such that the two apertures align when the second roof structure is positioned relative to the first roof structure in step 214. For example, each roof structure may include a rigging plate extending from an upper surface of a lateral frame member adjacent the other roof structure. The rigging plate may include a rigging point and an aperture sized to receive a fastener assembly.

Connecting the roof structures may include installing a fastener assembly through the aligned apertures. For example, the step may include extending a bolt through the apertures and threading a nut onto a distal end of the bolt. Securing the nut and bolt may thereby secure the second roof structure to the first roof structure.

Additional panels may be similarly installed to the building frame to form a desired roof. For example, steps 210-218 may be repeated for a third roof structure. Method 200 may be repeated for a plurality of roof structures and a plurality of horizontal members of the building frame. The method may also be used in combination with traditional roof construction techniques and/or other panelized building technology.

The different embodiments and examples of the roof panel system and related methods described herein provide several advantages over known solutions for constructing a roof. For example, illustrative embodiments and examples described herein improve construction safety by reducing exposure time of workers on the roof. Additionally, and among other benefits, illustrative embodiments and examples described herein allow a majority of welding to be done in controlled conditions, to a higher standard than is achievable in the field. Additionally, and among other benefits, illustrative embodiments and examples described herein produce a seismically robust building, with the roof providing a structural diaphragm.

No known system or device can perform these functions, particularly with standard parts and simple installation. Thus, the illustrative embodiments and examples described herein are particularly useful for faster on-site construction of panelized buildings. However, not all embodiments and examples described herein provide the same advantages or the same degree of advantage.

ADDITIONAL EXAMPLES AND ILLUSTRATIVE COMBINATIONS

This section describes additional aspects and features of roof panel systems according to the present teachings, and related systems and methods, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A0. A roof panel system, comprising:

a prefabricated horizontal building frame component including a plate having a first aperture, the plate extending perpendicular to a slope of a roof including the roof panel system, a prefabricated roof panel structure having two parallel lateral structural members and two parallel transverse structural members, one of the transverse structural members having a second aperture, and a fastener assembly connecting the horizontal building frame component to the roof panel structure through the first and second apertures.

A1. The system of A0, wherein the roof panel structure further includes decking coupled to the lateral structural members.

A2. The system of A0, wherein the plate is configured to support the roof panel structure against gravitational forces.

A3. The system of A0, wherein the plate is configured to be the only connection between the horizontal building frame component and a bottom edge of the roof panel structure.

A4. The system of A0, wherein the lateral structural members and the transverse structural members are C-channels.

A5. The system of A0, wherein the second aperture is in a plate coupled to said one of the transverse structural members.

A6. The system of A0, wherein the roof panel structure forms part of a roof of a building, the roof being configured to act as a structural diaphragm of the building.

A7. The system of A0, wherein the roof panel structure has a width selected to allow transportation under a standard wide load trucking permit.

A8. The system of A0, further including:

a prefabricated vertical building frame component including a vertical shear plate having a third aperture, and a fastener assembly connecting the vertical building frame component to the roof panel structure through the third aperture and through a fourth aperture in one of the lateral structural members of the roof panel structure.

A9. The system of A0, wherein the roof panel structure is a first roof panel structure and the system further includes a second roof panel structure coupled to the first roof panel structure.

A10. The system of A9, wherein a first lateral structural member of the first roof panel structure is coupled to an adjacent second lateral structural member of the second roof panel structure.

A11. The system of A10, further including:

a prefabricated vertical building frame component including a vertical shear plate having a third aperture, and a fastener assembly connecting the vertical building frame component to the first and second roof panel structures through the third aperture, through a fourth aperture in the first lateral structural member and a fifth aperture in the second lateral structural member, wherein the vertical shear plate is disposed between the first and second lateral structural members.

A12. The system of A10, wherein the first lateral structural member is spaced from the second lateral structural member.

A13. The system of A12, wherein the spacing between the first and second lateral structural members is configured to accommodate a fabrication tolerance.

A14. The system of A9, wherein the first roof panel structure is connected to the second roof panel structure by a fastener assembly extending through a first aperture in a rigging plate of the first roof panel structure and through a second aperture in a rigging plate of the second roof panel structure, the rigging plates being configured for connection of lifting equipment.

A15. The system of A14, wherein the rigging plate of the first roof panel structure is staggered relative to the rigging plate of the second roof panel structure.

A16. The system of A9, further including a permanent fall protection tie off point coupled to the first and second roof panel structures.

A17. The system of A0, wherein the horizontal building frame component is a lower horizontal building frame component and the plate is a first plate, further including an upper horizontal building frame component having a second plate, the first plate configured to connect the lower horizontal building frame component and a bottom edge of the roof panel structure, and the second plate configured to connect the upper horizontal building frame component and a top edge of the roof panel structure.

B0. A method of constructing a roof, comprising prefabricating a modular roof structure, including two parallel lateral structural members and two parallel transverse structural members, at least one of the transverse members having a first aperture, lifting the roof structure onto two horizontal members of a building frame, at least one of the horizontal members including a plate coupled to an upper surface, the plate being perpendicular to a slope of the roof, and having a second aperture, supporting the roof structure on the horizontal members and the plate, connecting the roof structure to the building frame with a fastener assembly extending through the first and second apertures.

B1. The method of B0, wherein the roof structure is a first roof structure and further including:

lifting a second roof structure onto the horizontal members of the building frame, adjacent the first roof structure, and connecting the first roof structure to the second roof structure with a fastener assembly extending through a third aperture of the first roof structure and a fourth aperture of the second roof structure.

C0. A roof of a building, comprising:

a plurality of prefabricated roof panel structures, each roof panel structure including two parallel lateral structural members and two parallel transverse structural members, wherein each roof panel structure is coupled to a plate by a fastener assembly, the plate being connected to a horizontal frame member of the building, and each roof panel structure is coupled to an adjacent roof panel structure by at least one fastener assembly.

C1. The roof of C0, wherein each roof panel structure further includes decking coupled to the lateral structural members.

C2. The roof of C0, wherein each plate is configured to support the corresponding roof panel structure against gravitational forces.

C3. The roof of C0, wherein each plate extends perpendicular to a slope of the roof.

C4. The roof of C0, wherein the lateral structural members and the transverse structural members of each roof panel structure are C-channels.

C5. The roof of C0, wherein the roof is configured to act as a structural diaphragm of the building.

C6. The roof of C0, wherein each roof panel structure is spaced from adjacent roof panel structures.

C7. The roof of C0, further including a plurality of permanent fall protection tie off anchors, each anchor coupled to two adjacent roof panel structures.

CONCLUSION

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

The various structural members disclosed herein may be constructed from any suitable material, or combination of materials, such as metal, plastic, nylon, timber, rubber, or any other materials with sufficient structural strength to withstand the loads incurred during use. Materials may be selected based on their durability, flexibility, weight, and/or aesthetic qualities.

Although the present disclosure has been provided with reference to the foregoing operational principles and embodiments, it will be apparent to those skilled in the art that various changes in form and detail may be made without departing from the spirit and scope of the disclosure. The present disclosure is intended to embrace all such alternatives, modifications and variances. Where the disclosure recites "a," "a first," or "another" element, or the equivalent thereof, it should be interpreted to include one or more such elements, neither requiring nor excluding two or more such elements. Furthermore, any aspect shown or described with reference to a particular embodiment should be interpreted to be compatible with any other embodiment, alternative, modification, or variance.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. A roof of a building, comprising:

a plurality of prefabricated roof panel structures, each roof panel structure including two parallel lateral structural members and two parallel transverse structural members connected to the lateral structural members, wherein:

a first transverse structural member of the two parallel transverse structural members of each roof panel structure is coupled to a respective plate by a first fastener assembly, the plate is down a slope of the roof from the first transverse structural member, spaced from a first end and a second end of the first transverse structural member, and connected to a horizontal frame member of the building, each roof panel structure is coupled to an adjacent roof panel structure by a second fastener assembly, and the first transverse structural member of each roof panel structure is parallel to the horizontal frame member to which the respective coupled plate is connected.

2. The roof of claim 1, wherein each plate extends perpendicular to the slope of the roof.

3. The roof of claim 1, wherein each plate is configured to act as a gravity catch.

4. The roof of claim 1, wherein the transverse structural members of the plurality of prefabricated roof panel structures and the horizontal frame members of the building extend perpendicular the slope of the roof, and the lateral structural members of the plurality of prefabricated roof panel structures extend parallel the slope of the roof.

5. A method of constructing a roof, comprising:

prefabricating a modular roof structure, including two parallel lateral structural members and two parallel transverse structural members connected to the lateral structural members, first transverse member of the two parallel transverse members having a first aperture, lifting the roof structure onto two horizontal members of a building frame, at least one of the horizontal members including a plate coupled to an upper surface, the plate being perpendicular to a slope of the roof, and having a second aperture, supporting the roof structure on the horizontal members and the plate by resting the first transverse member against the plate, connecting the roof structure to the building frame with a fastener assembly extending through the first and second apertures, wherein the supporting step includes supporting the roof structure on the plate prior to connecting the roof structure to the building frame, and lifting the roof structure onto the two horizontal members of the building frame includes disposing the two parallel transverse structural members parallel to the two horizontal members of the building frame.

6. The method of claim 5, wherein the plate acts as a gravity catch in the supporting step.

7. The method of claim 5, wherein the supporting step includes supporting the roof structure on the plate while connecting the roof structure to the building frame.

8. A method of constructing a roof, comprising:

prefabricating a modular roof structure, including two parallel lateral structural members and two parallel transverse structural members connected to the lateral structural members, at least one of the transverse members having a first aperture, lifting the roof structure onto two horizontal members of a building frame and disposing the two parallel transverse structural members of the roof structure parallel to the two horizontal members of the building frame, wherein at least one of the horizontal members includes a plate coupled to an upper surface, the plate being perpendicular to a slope of the roof, and having a second aperture, supporting the roof structure on the horizontal members and the plate, connecting the roof structure to the building frame with a first fastener assembly extending through the first and second apertures, wherein the roof structure is a first roof structure and further including:

lifting a second roof structure onto the horizontal members of the building frame, adjacent the first roof structure, and connecting the first roof structure to the second roof structure with a second fastener assembly extending through a third aperture of the first roof structure and a fourth aperture of the second roof structure.

* * * * *